US005408981A

United States Patent [19]

Tomisawa

[11] Patent Number: 5,408,981

[45] Date of Patent: Apr. 25, 1995

[54] APPARATUS AND METHOD FOR CONTROLLING AIR/FUEL MIXTURE RATIO IN FEEDBACK CONTROL MODE FOR INTERNAL COMBUSTION ENGINE

[75] Inventor: Naoki Tomisawa, Atsugi, Japan

[73] Assignee: Unisia Jecs Corporation, Atsugi, Japan

[21] Appl. No.: 131,220

[22] Filed: Oct. 6, 1993

[30] Foreign Application Priority Data

Oct. 8, 1992 [JP] Japan ..... 4-270512

[51] Int. Cl.[6] ..... F02D 41/14

[52] U.S. Cl. ..... 123/681; 123/685; 123/688

[58] Field of Search ..... 123/681, 685, 686, 688

[56] References Cited

U.S. PATENT DOCUMENTS 4,449,502 5/1994 Furuhashi ..... 123/685

4,505,246 3/1995 Nakajima et al. ..... 123/688

FOREIGN PATENT DOCUMENTS 60-240840 11/1985 Japan .

*Primary Examiner*—Andrew M. Dolinar

*Attorney, Agent, or Firm*—Foley & Lardner

[57] ABSTRACT

An apparatus and method for controlling an air/fuel mixture ratio for an internal combustion engine which can start the air/fuel mixture ratio at a earlier timing than the conventional air/fuel mixture ratio controlling apparatus. For example, a control unit determines whether the engine is revolved and, thereafter, accumulates an intake air quantity. When the accumulated value exceeds the predetermined value $SQ_{ST}$ and the control unit determines that the activation of an oxygen sensor sufficiently occurs, the start of the air/fuel mixture ratio feedback control is determined. At this time, a fuel supply quantity $T_I$ is corrected so that the air/fuel mixture ratio which tends to be inclined to a lean side is shifted to the rich side.

12 Claims, 4 Drawing Sheets

APPARATUS AND METHOD FOR CONTROLLING AIR/FUEL MIXTURE RATIO IN FEEDBACK CONTROL MODE FOR INTERNAL COMBUSTION ENGINE

BACKGROUND OF THE INVENTION

1. Field of the Invention

The present invention relates to an apparatus and method for controlling air/fuel mixture ratio for an internal combustion engine in a feedback mode.

2. Description of the Background Art

A Japanese Patent Application First Publication No. Showa 60-240840 exemplifies a previously proposed air/fuel mixture ratio feedback controlling apparatus.

In the above-identified Japanese Patent Application First Publication, an intake air flow quantity Q and engine revolution speed N are detected so as to calculate a basic fuel supply quantity Tp ($=K \cdot Q/N$; K denotes a proportional constant). The feedback correction for the basic fuel supply quantity Tp according to the correction by means of an engine temperature is carried out in response to an oxygen sensor detecting an air/fuel mixture ratio of the air/fuel mixture according to a detection result of oxygen concentration in the exhaust gas. Then, a final fuel supply quantity $T_I$ is determined according to the Tp which is corrected with a variation in a battery voltage.

Specifically, since the output signal of the oxygen sensor is inverted as a stoichiometric air/fuel mixture ratio as a boundary, the inversion of the output signal therefrom causes an increase or decrease of the fuel supply quantity so that a feedback correction coefficient by which the basic fuel supply quantity Tp is to be multiplied is set by means of a proportional-integral control (PI control). Thereafter, a drive pulse signal whose pulsewidth corresponds to the finally set fuel supply quantity $T_I$ is output from a control unit at a predetermined timing of fuel supply so that a previously determined quantity of fuel is injected into the engine.

The air/fuel mixture ration feedback correction based on the air/fuel mixture ratio detector (oxygen sensor) is carried out such that the air/fuel mixture ratio is controlled to approach to the target (stoichiometric) air/fuel mixture ratio. This is because in order to secure a high exhaust gas purification performance, a conversion efficiency (purification efficiency) of a three-catalytic converter installed in the exhaust gas passage so as to oxidize CO and HC (hydrocarbon) and so as to reduce $NO_x$ can effectively function in an exhaust gas state during a combustion of the stoichiometric air/fuel mixture.

Then, proportional component and integral component are set respectively, for example, according to a deviation between the air/fuel mixture ration detected by the oxygen sensor and the target air/fuel mixture ratio and the added value of the proportional and integral components is multiplied by the basic fuel supply quantity Tp as a value of $\alpha$ so that the air/fuel mixture ratio is controlled to a position placed in a proximity to the stoichiometric air/fuel mixture ratio.

In the air/fuel mixture feedback control system or apparatus described above, the feedback control of the air/fuel mixture ratio based on the output signal of the oxygen sensor is started after a predetermined time from a confirmation of state in which an activation of the oxygen sensor is determined and a preferable output characteristic is obtained upon the lapse of the predetermined time.

However, an industrial demand has been issued to promote the exhaust purification performance during an interval from a cold state to a warmed up state with the air/fuel mixture feedback control carried out as early as possible.

To make the start of the air/fuel mixture ratio earlier than usual, it is necessary to start the air/fuel mixture ratio immediately after an activation determination of the oxygen sensor such that an activation of the oxygen sensor is determined in the vicinity to a limit of the output signal of the oxygen sensor. However, when the activation of the oxygen sensor is insufficient, a point at which the output signal of the oxygen sensor is inverted is shifted away from the stoichiometric air/fuel mixture ratio so that it is impossible to carry out the feedback control in the vicinity to the stoichiometric air/fuel mixture ratio. A direction of the shifted point is generally toward a lean side although the shifted point is different according to the characteristics of the oxygen sensor.

SUMMARY OF THE INVENTION

It is, therefore, a principal object of the present invention to provide an improved apparatus and method for controlling an air/fuel mixture ratio in a feedback control mode which carry out a correction toward an air/fuel mixture feedback control under a state wherein an activation of the oxygen sensor is insufficient so that the air/fuel mixture ratio can speedily approach the stoichiometric air/fuel mixture ratio and so that the start of the air/fuel mixture ratio feedback control can become as early as possible, thereby an exhaust gas purification performance being as high as possible.

The above-described object can be achieved by providing an apparatus for controlling an air/fuel mixture ratio in a feedback control mode for an internal combustion engine, comprising: a) an oxygen sensor which is so constructed as to be disposed in an exhaust gas passage and as to produce a voltage signal according to a concentration of oxygen in an exhaust gas which is varied according to an air/fuel mixture supplied to the engine; b) feedback control means for controlling the air/fuel mixture ratio on the basis of the output voltage signal of the oxygen sensor so that the air/fuel mixture ratio approaches to a target air/fuel mixture ratio; c) first means for detecting an instantaneous intake air quantity sucked into the engine; d) second means for estimating an activation state of the oxygen sensor on the basis of the intake air quantity; e) third means for setting a start timing of the air/fuel mixture ratio feedback control by said feedback control means on the basis of the estimated state of the activation of the oxygen sensor; and f) fourth means for correcting a relationship between a rich side control and a lean side control of the air/fuel mixture-ratio for the output voltage state of the oxygen sensor on the basis of an accumulated value of the intake air quantity after the start timing of the air/fuel mixture ratio feedback control set by said third means.

The above-described object can also be achieved by providing a method for controlling an air/fuel mixture ratio in a feedback control mode for an internal combustion engine having an oxygen sensor so constructed as to produce an output voltage signal on the basis of an air/fuel mixture ratio of fuel supplied to the engine and having means for controlling the air/fuel mixture ratio on the basis of the output voltage signal of the oxygen sensor, comprising the steps of: a) determining whether an activation of the oxygen sensor occurs from an output state of the oxygen sensor; b) starting the feedback control of the air/fuel mixture ratio when said step a) determines that the activation of the oxygen sensor occurs; c) detecting an intake air quantity; d) accumulating the intake air quantity after the start of the air/fuel mixture feedback control of said step b); and e) correcting a relationship between an increase side and decrease side of the air/fuel mixture ratio with respect to the output voltage signal of the oxygen sensor on the basis of the accumulated intake air quantities.

The above-described object can also be achieved by providing a method for controlling an air/fuel mixture ratio in a feedback control mode for an internal combustion engine having an oxygen sensor so constructed as to produce an output voltage signal on the basis of an air/fuel mixture ratio of fuel supplied to the engine and having means for controlling the air/fuel mixture ratio on the basis of the output voltage signal of the oxygen sensor, comprising the steps of: a) determining whether the engine is revolved; b) detecting an intake air quantity sucked into the engine; c) accumulating the intake air quantity after the engine is revolved; d) setting a start timing of the air/fuel mixture ratio feedback control on the basis of the accumulated value of the intake air quantity; and e) correcting a relationship between controls in an increase side and decrease side of the air/fuel mixture ratio with respect to the output voltage signal on the basis of the accumulated value of the intake air quantity after the start of the air/fuel mixture ratio feedback control.

DESCRIPTION OF THE PREFERRED EMBODIMENTS

Reference will hereinafter be made to the drawings in order to facilitate a better understanding of the present invention.

Figure 1:
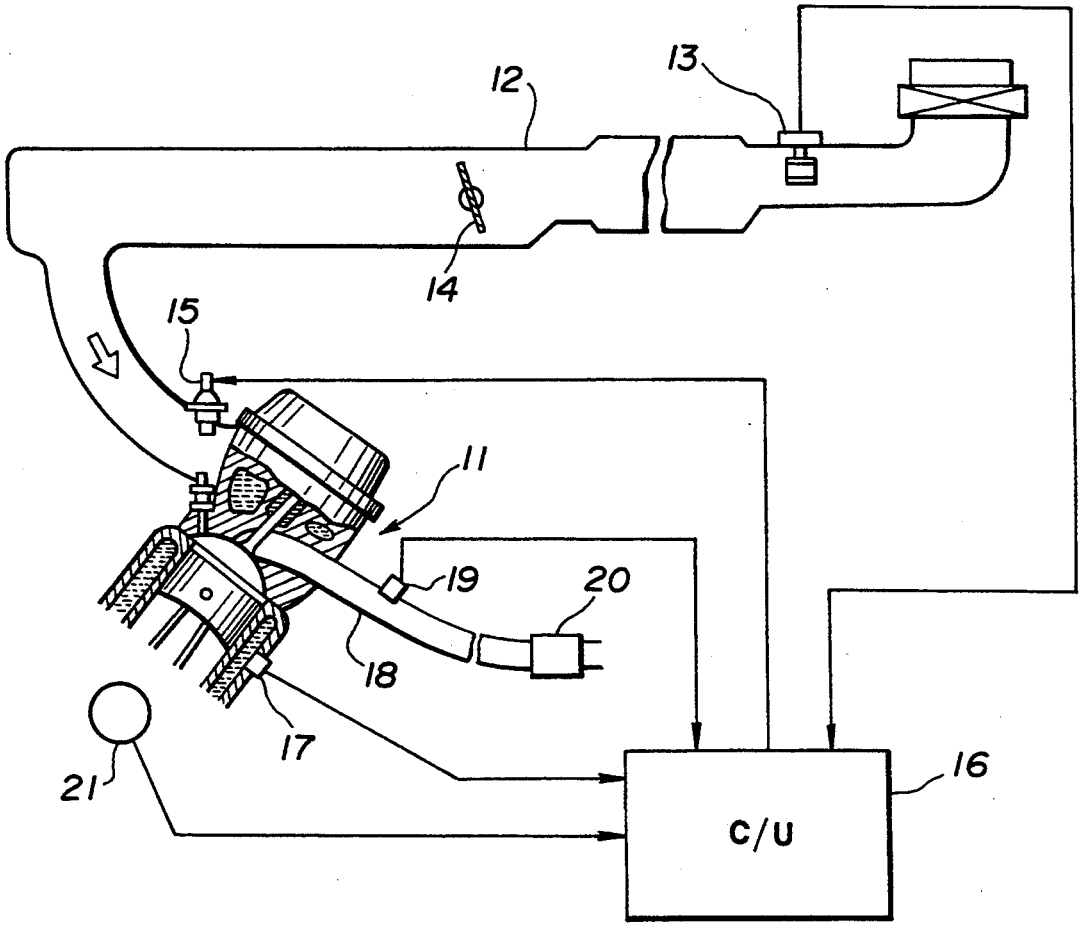
FIG. 1 is a schematic explanatory view of an internal combustion engine to which an apparatus for controlling an air/fuel mixture ratio in a feedback mode is applicable.

FIG. 1 shows a first preferred embodiment of an air/fuel mixture ratio feedback controlling apparatus applicable to an internal combustion engine.

In FIG. 1, an intake air passage 12 of an engine 11 is provided with an airflow meter 13 and a throttle valve 14 interlocked with an accelerator (not shown). An electromagnetic type fuel injection valve 15 is installed at a portion of the intake air passage 12 downstream of the throttle valve 14. The fuel injection valve 15 is driven by means of a fuel injection pulse signal derived from a control unit 16 so that a fuel controlled under a predetermined pressure by means of a pressure regulator and pressurized by means of a fuel pump (not shown) is injected into a part of the intake air passage near to the engine 11. Furthermore, a coolant temperature sensor 17 is installed in a water jacket of the engine 11 to detect a coolant temperature Tw. In addition, an oxygen sensor 19 is installed in an exhaust gas passage 18 to detect an oxygen concentration in the exhaust gas of the engine 11 so that the air/fuel mixture ratio of a sucked air/fuel mixture. Then, a three-catalytic converter 20 which is located on a part of the exhaust gas passage 18 downstream of the oxygen sensor 19 and which oxidizes CO and HC components of the exhaust gas and which reduces $NO_x$ to purify the exhaust gas into the air.

A crank angle sensor 21 is built in a ignition distributor (not shown). The control unit 16 counts the number of crank unit angle signals derived from the crank angle sensor 21 for a predetermined count interval of time or measures a period of a crank angle reference angle signal from the crank angle sensor 21 so that the control unit 16 determines an engine revolution speed N.

Figure 2:
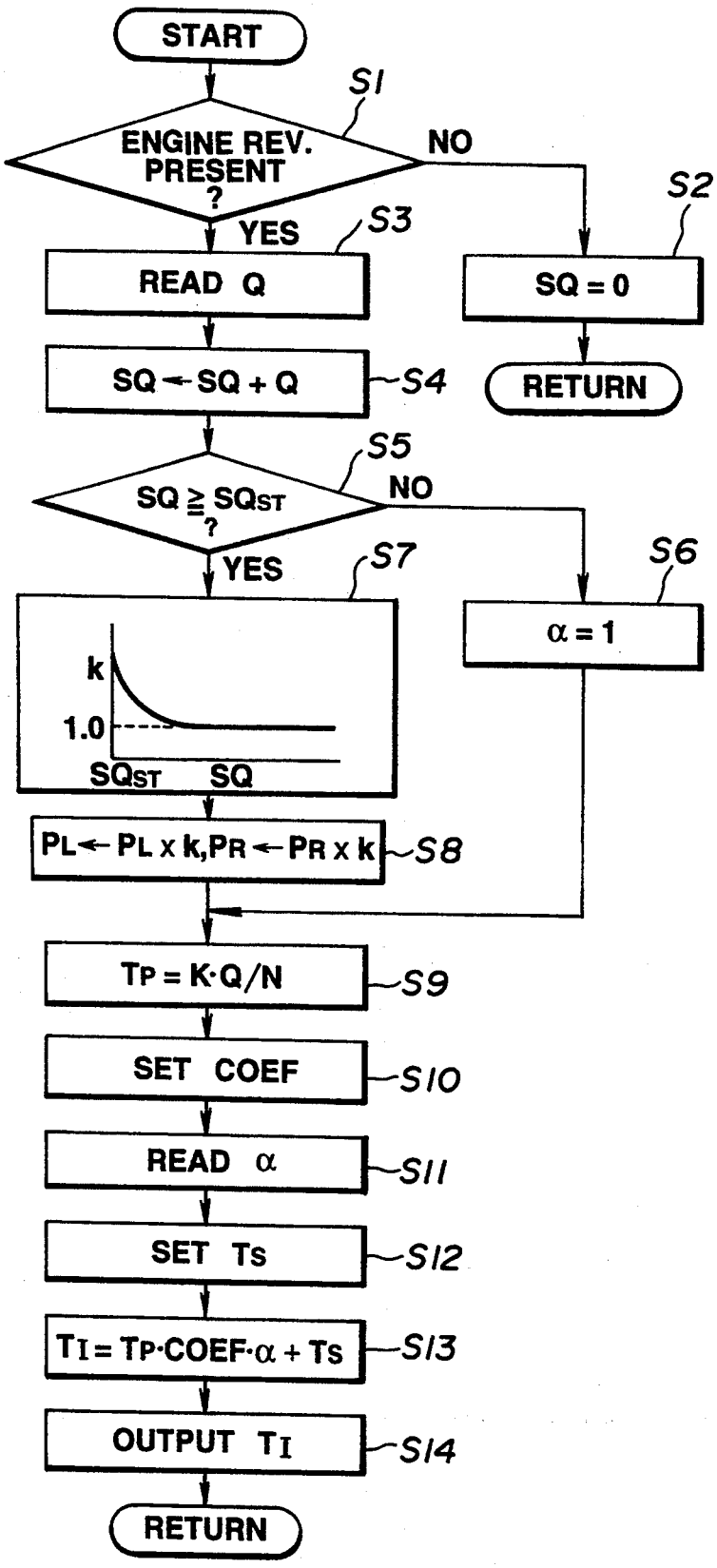
FIG. 2 is an operational flowchart of a fuel injection quantity setting routine in a first preferred embodiment of the air/fuel mixture ratio controlling apparatus shown in FIG. 1.
Figure 3:
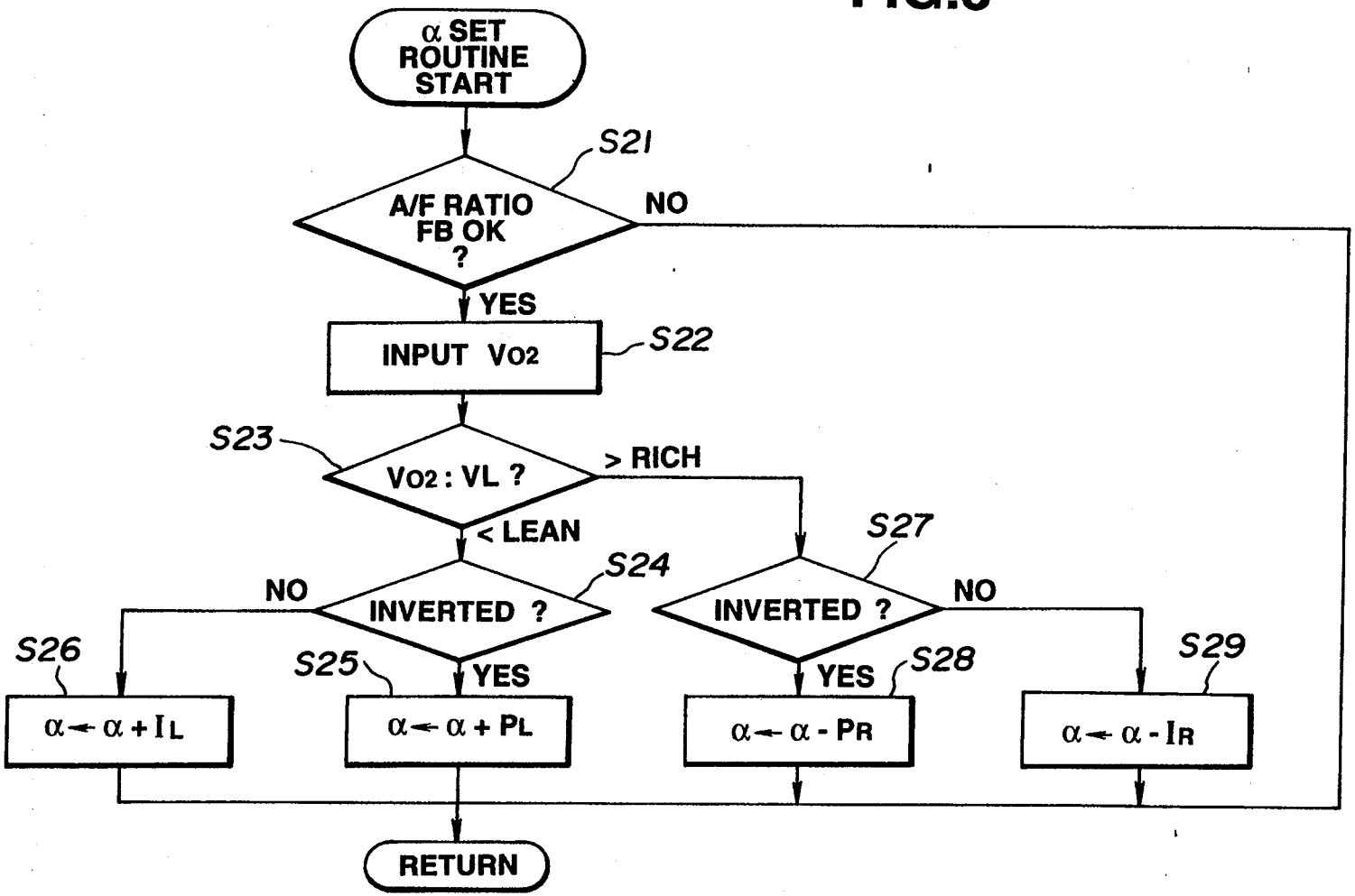
FIG. 3 is an operational flowchart of a correction coefficient setting routine in the case of FIG. 2.

FIGS. 2 and 3 show operational flowcharts executed by the control unit 16. Both routines shown in FIGS. 2 and 3 are executed for each predetermined period (for example, 10 msec.). The control unit 16 usually includes a CPU, ROM, RAM, I/O ports, and common bus.

At a step S1 of FIG. 2, the control unit 16 determines whether a signal is input from the crank angle sensor 21 to determine whether the engine 11 is revolved.

If the control unit 16 determines that the engine is not revolved (NO), the routine goes to a step S2 in which an accumulated value SQ of the intake air quantity is reset to zero and the routine is ended.

If the control unit 16 determines that the engine is revolved, the routine goes to a step S3 in which an intake air quantity D is read from the airflow meter. At a step S4, a presently read intake air quantity Q is added to an accumulated value SQ of the intake air quantity accumulated until now so as to update the accumulated value as a newly accumulated value SQ ($SQ \leftarrow SQ+Q$).

At a step S5, the control unit 16 determines whether the accumulated value SQ has reached a predetermined value $SQ_{ST}$ which corresponds to a receiving heat quantity by which the oxygen sensor 19 is generally activated.

Before reaching the predetermined value $SQ_{ST}$ (if NO at the step S5), the routine goes to a step S6 in which a feedback correction coefficient $\alpha$ is fixed to a predetermined value (for example, 1) so that the air/fuel mixture ratio is halted and the routine goes to a step S9.

When, at the step S5, the control unit 16 determines that the accumulated value of SQ has reached the predetermined value $SQ_{ST}$, the routine goes to a step S7 in which a correction coefficient k of a proportional component P in a feedback correction coefficient in the air/fuel mixture ratio feedback control to shift a control point in the air/fuel mixture feedback control is retrieved from a previously set ROM map on the basis of the accumulated value SQ. It is noted that a value of the correction coefficient is set to a larger value ($>1$) as the accumulated value SQ becomes smaller. In addition, the correction coefficient value k is set to 1 so as to release a substantial correction from a time when the accumulated value SQ becomes larger than a certain value and the oxygen sensor 19 is sufficiently activated.

At a step S8, the control unit 16 updates the proportional component $P_R$ in a direction to enrich the air/fuel mixture and the other proportional component $P_L$ in a direction to make lean the air/fuel mixture ratio by a value multiplied by the value of k.

It is noted that both basic proportional components of $P_L$ and $P_R$ are simply made to fixed values or may alternatively be set or varied on the basis of the engine driving condition. However, under the same engine driving condition, such a setting as $P_R > P_L$ is carried out.

Hence, since the value of correction coefficient k is larger than 1 when the accumulated value SQ is small, a difference between the proportional components $P_R$ and $P_L$ is increased so that the neutral point between the rich and lean air/fuel mixture is corrected to a center value of control of the air/fuel mixture ratio.

Then, at a step S9, a basic fuel injection quantity Tp corresponding to the intake air quantity per revolution is calculated on the basis of the intake air quantity Q derived from the airflow meter 13 and the engine revolution speed N derived on the basis of the crank angle signal derived from the crank angle sensor 21 as follows:

$$T_p = K \times Q/N \text{ (K denotes a constant).}$$

At a step S10, various correction coefficients COEF are set on the basis of the engine coolant temperature Tw detected by the coolant temperature sensor 17 and so on.

At a step S11, the control unit 16 reads the feedback correction coefficient $\alpha$ set on the basis of a signal derived from the oxygen sensor 19 at another feedback correction coefficient setting routine as will be described later. However, if passed through the step S6, the value of $\alpha$ is fixed predetermined value and is read at the step S11.

At a step S12, a voltage correction coefficient Ts is set on the basis of a battery voltage value. This correction is based on the fact that a battery voltage variation causes a variation in a fuel injection flow quantity of the fuel injection valve 15.

At a step S13, a final fuel injection quantity $T_I$ is calculated using the following equation:

$$T_I = T_P \times COEF \times \alpha + T_S.$$

At a step S14, the control unit 16 sets the finally calculated fuel injection quantity $T_I$ into an output register.

Thus, a drive pulse signal whose pulsewidth corresponds to the final fuel injection quantity $T_I$ is supplied to the fuel injection valve 15 at a predetermined fuel injection timing which synchronizes with the engine revolution so as to inject the fuel determined as $T_I$ into the engine 11.

Next, the feedback correction coefficient setting routine will be described below with reference to FIG. 3.

FIG. 3 shows the feedback correction coefficient setting routine in the first embodiment described above. This routine is executed in synchronization with the engine revolution.

At a step S21, the control unit 16 determines whether the engine 11 falls in the engine driving condition which should be carried out with the feedback control of the air/fuel mixture ratio. If not satisfy this engine driving condition, the routine is ended. In this case, the feedback correction coefficient $\alpha$ is clamped at the value when the previously carried out feedback control end or at a constant reference value. Then, the feedback control is halted.

When, at a step S22, the control unit S21 determines that the air/fuel mixture ratio feedback condition is satisfied, the routine goes to a step S22 in which a voltage signal $V_{02}$ derived from the oxygen sensor 19 is input to the control unit 16.

At a step S23, the control unit 16 determines whether the voltage signal of the oxygen sensor 19 input at the step S22 is compared with a reference value SL corresponding to the stoichiometric air/fuel mixture ratio to determine whether the present voltage signal $V_{02}$ indicates a rich state or lean state.

When the air/fuel mixture ratio is lean ($V_{02} < SL$), the routine goes to a step S24 in which the control unit 16 determines whether the air/fuel mixture ratio at this time (or immediately after the reverse) is reversed.

At the step S24, if YES, the routine goes to a step S25 in which the air/fuel mixture ratio feedback correction coefficient $\alpha$ is updated by the present value to which the predetermined proportional component $P_L$ is added. If NO at the step S24 (not in the reverse state), the routine goes to a step S26 in which the air/fuel mixture ratio feedback correction coefficient $\alpha$ is updated by the present value to which the predetermined integral component $I_L$ is added.

On the other hand, when, at the step S23, the air/fuel mixture ratio indicates rich ($V_{02} > SL$), the routine goes to a step S27 in which the control unit 16 determines whether the reverse from the rich state to the lean state occurs at this time (lean→rich).

If the reverse from the lean state to the rich state occurs at the same time at the step S27 (YES), the routine goes to a step S28 in which the air/fuel mixture ratio feedback correction coefficient $\alpha$ is updated by the present value from which the predetermined integral component $I_L$ is subtracted.

At the routine shown in FIG. 3, the feedback correction coefficient $\alpha$ is determined and is supplied to the above-described fuel injection setting routine shown in FIG. 2 so that the final fuel injection quantity $T_I$ is set.

In the first embodiment, since the start of the air/fuel mixture ratio occurs at a time when the oxygen sensor 19 is generally inferred to be activated, the start timing can become earlier and such a correction that the tendency of leaned air/fuel mixture ratio due to an insufficient activation of the oxygen sensor 19 for a while upon the start of the air/fuel mixture ratio feedback control is corrected in the direction to become rich so as to approach the stoichiometric air/fuel mixture ratio, thus the difference between the proportional component $P_R$ in the direction of rich and the other proportional component $P_L$ in the direction of lean being large. Consequently, at the initial time when the activation of the oxygen sensor 19 is not sufficient, a preferable air/fuel mixture ratio feedback control can be achieved so that a higher exhaust gas purification can be achieved.

It is noted that the correction is carried out so that the air/fuel mixture ratio becomes rich. In a case where another type of the oxygen sensor which tends to become lean in a state where the activation thereof is insufficient, the correction may be made such that the proportional component $P_L$ in the direction of lean is larger than the proportional component $P_R$ in the direction of rich.

In addition to the correction of the air/fuel mixture ratio such that the magnitudes of proportional components in the directions of rich and lean are varied, the reference value SL to be compared with the voltage signal $V_{02}$ of the oxygen sensor 19 may, for example, be increased or decreased so that the air/fuel mixture ratio may be enriched (SL increase correction) or made lean (SL decrease correction). Otherwise, although the reference value S1 is fixed at the constant, another correction coefficient m may be multiplied by the output voltage signal $V_{02}$ so as to enrich the air/fuel mixture ratio ($m<1$) or to make lean the air/fuel mixture ratio ($m>1$).

Figure 4:
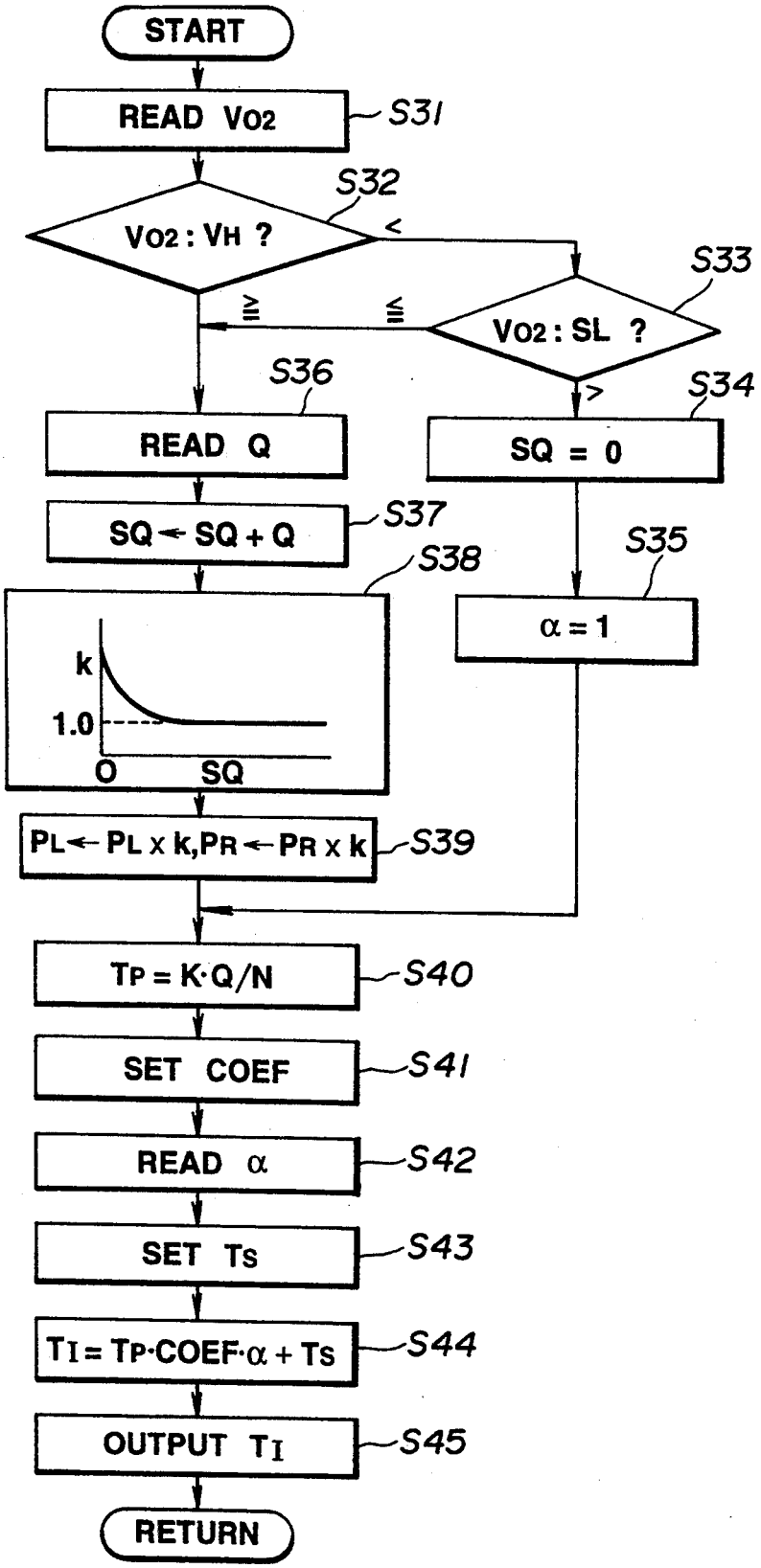
FIG. 4 is an operational flowchart of the fuel injection quantity setting routine in a second preferred embodiment of the air/fuel mixture ratio feedback control apparatus.

Next, FIG. 4 shows a fuel injection quantity setting routine in a case of a second preferred embodiment of the air/fuel mixture ratio feedback controlling apparatus.

The structure of the second preferred embodiment is the same as the first embodiment shown in FIG. 1.

At a step S31, the voltage signal $V_{02}$ is read from the oxygen sensor 19.

At a step S32, the control unit 16 compares the output voltage signal $V_{02}$ with a high voltage side reference value $V_R$ (for example, 0.7 volts).

If $V_{02}<V_R$ at the step S32, the routine advances to a step S33 in which the voltage signal $V_{02}$ is compared with a low voltage side reference value $V_L$ (for example, 0.3 volts).

If $V_{02}>V_L$ at the step S33, the control unit 16 determines that the activation of the oxygen sensor 19 is not yet sufficient and the routine goes to a step S34 in which the accumulated value SQ is reset to zero. Thereafter, the routine goes to a step S35, the feedback correction coefficient $\alpha$ is fixed to 1 and the air/fuel mixture ratio feedback correction coefficient is halted and the routine goes to a step S40.

On the other hand, if, at the step S31, $V_{02}\leqq V_H$, or if, at the step S33, $V_{02}\leqq V_L$, the control unit 16 determines that the activation of the oxygen sensor 19 is generally sufficient and the routine goes to a step S36.

At the step S36, the intake air quantity Q is read, at a step S37, the accumulated value SQ is derived, and, at the step S38, the correction coefficient k for the accumulated value of SQ is retrieved.

In the case of FIG. 2, the intake air quantity is accumulated immediately after the detection of the engine revolution.

In the case of FIG. 3, since the intake air quantity Q is accumulated as SQ after the detection of the activation of the oxygen sensor 19, the same value of k is set for a case of a value of $SQ_{ST}$ subtracted from the value of SQ.

It is noted steps S39 through S45 are the same as the steps 8 through 14.

In the second embodiment, the same effect as in the case of the first embodiment can be achieved. However, since the detection of activation of the oxygen sensor is based on the output state of the oxygen sensor 19, a more accurate detection of the activation thereof can be achieved.

It is also noted that the correction for the reference value SL or for the voltage signal $V_{02}$ may alternatively be carried out in place of the correction of the proportional component.

As described hereinabove, in the apparatus and method for controlling the air/fuel mixture ratio in the feedback control mode according to the present invention, the deviation of the air/fuel mixture ratio with respect to a point of the stoichiometric air/fuel mixture ratio during the insufficient activation of the used oxygen sensor can be corrected. Therefore, a earlier start of the air/fuel mixture ratio feedback control can be achieved and, consequently, the exhaust gas purification performance can be improved.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. An apparatus for controlling an air/fuel mixture ratio in a feedback control mode for an internal combustion engine, comprising:

a) an oxygen sensor which is so constructed as to be disposed in an exhaust gas passage and as to produce a voltage signal according to a concentration of oxygen in an exhaust gas which is varied according to an air/fuel mixture supplied to the engine;

b) feedback control means for controlling the air/fuel mixture ratio on the basis of the output voltage signal of the oxygen sensor so that the air/fuel mixture ratio approaches to a target air/fuel mixture ratio;

c) first means for detecting an instantaneous intake air quantity sucked into the engine;

d) second means for estimating an activation state of the oxygen sensor on the basis of the intake air quantity;

e) third means for setting a start timing of the air/fuel mixture ratio feedback control by said feedback control means on the basis of the estimated state of the activation of the oxygen sensor; and f) fourth means for correcting a relationship between a rich side control and a lean side control of the air/fuel mixture ratio for the output voltage state of the oxygen sensor on the basis of an accumulated value of the intake air quantity after the start timing of the air/fuel mixture ratio Feedback control set by said third means.

2. An apparatus for controlling an air/fuel mixture ratio in a feedback control mode for an internal combustion engine as set forth in claim 1, which further includes fifth means for determining an engine revolution speed and determining whether the engine is revolved and sixth means for accumulating the intake air quantity after the fifth means determines that the engine is revolved and wherein said second means estimates the activation of the oxygen sensor on the basis of the accumulated value of the intake air quantity.

3. An apparatus for controlling an air/fuel mixture ratio in a feedback control mode for an internal combustion engine as set forth in claim 2, wherein said second means estimates the activation of the oxygen sensor on the basis of whether the accumulated value of the intake air quantity at the present time reaches a predetermined value of $SQ_{ST}$ and wherein said feedback control means sets a first correction coefficient k according to the value of accumulated intake air quantity SQ and sets both proportional component in a direction of lean $P_L$ and proportional component in a direction of rich $P_R$ as follows: $P_L \leftarrow P_L \times k$ and $P_R \leftarrow P_R \times k$.

4. An apparatus for controlling an air/fuel mixture ratio in a feedback control mode for an internal combustion engine as set forth in claim 3, wherein when said second means determines that $SQ<SQ_{ST}$, a feedback correction coefficient $\alpha$ is set to one.

5. An apparatus for controlling an air/fuel mixture ratio in a feedback control mode for an internal combustion engine as set forth in claim 4, wherein the first correction coefficient k is set to a smaller value toward one as the accumulated value SQ exceeds $SQ_{ST}$ and becomes larger.

6. An apparatus for controlling an air/fuel mixture ratio in a feedback control mode for an internal combustion engine as set forth in claim 5, which further includes seventh means for determining a final fuel injection quantity as follows: $T_I = Tp \times COEF \times \alpha + Ts$, wherein Tp denoted a basic fuel injection quantity based on the intake air quantity Q and engine revolution speed N, COEF denotes various correction coefficients including a correction with respect to an engine coolant temperature and Ts denotes a correction coefficient on a variation in output voltage of a vehicle battery.

7. An apparatus for controlling an air/fuel mixture ratio in a feedback control mode for an internal combustion engine as set forth in claim 6, wherein a value of $\alpha$ is set on the basis of $P_L$, $P_R$, $I_L$ and $I_R$ wherein $I_L$ and $I_R$ denote integral components in the direction of lean and in the direction of rich.

8. An apparatus for controlling an air/fuel mixture ratio in a feedback control mode for an internal combustion engine as set forth in claim 7, wherein when the air/fuel mixture ratio is reversed to the rich side, $\alpha \leftarrow \alpha - P_R$, when the air/fuel mixture ratio is reversed to the lean side, $\alpha \leftarrow \alpha + P_L$, when the air/fuel mixture ratio is in the rich state, $\alpha \leftarrow \alpha - I_R$, and when the air/fuel mixture ratio is in the lean state, $\alpha \leftarrow \alpha + I_L$.

9. An apparatus for controlling an air/fuel mixture ratio in a feedback control mode for an internal combustion engine as set forth in claim 1, wherein said second means estimates the activation of the oxygen sensor according to an output state of the oxygen sensor and wherein said first means detects the intake air quantity after the estimation of the activation of the oxygen sensor by means of said second means.

10. An apparatus for controlling an air/fuel mixture ratio in a feedback control mode for an internal combustion engine as set forth in claim 9, wherein said second means either compares the output voltage signal of the oxygen sensor $V_{02}$ with a higher predetermined voltage $V_H$ or compares it with a lower predetermined voltage $V_L$ so as to determine whether the activation of the oxygen sensor occurs.

11. A method for controlling an air/fuel mixture ratio in a feedback control mode for an internal combustion engine having an oxygen sensor so constructed as to produce an output voltage signal on the basis of an air/fuel mixture ratio of fuel supplied to the engine and having means for controlling the air/fuel mixture ratio on the basis of the output voltage signal of the oxygen sensor, comprising the steps of:

a) determining whether an activation of the oxygen sensor occurs from an output state of the oxygen sensor;

b) starting the feedback control of the air/fuel mixture ratio when said step a) determines that the activation of the oxygen sensor occurs;

c) detecting an intake air quantity;

d) accumulating the intake air quantity after the start of the air/fuel mixture feedback control of said step b); and e) correcting a relationship between an increase side and decrease side of the air/fuel mixture ratio with respect to the output voltage signal of the oxygen sensor on the basis of the accumulated intake air quantities.

12. A method for controlling an air/fuel mixture ratio in a feedback control mode for an internal combustion engine having an oxygen sensor so constructed as to produce an output voltage signal on the basis of an air/fuel mixture ratio of fuel supplied to the engine and having means for controlling the air/fuel mixture ratio on the basis of the output voltage signal of the oxygen sensor, comprising the steps of:

a) determining whether the engine is revolved;

b) detecting an intake air quantity sucked into the engine;

c) accumulating the intake air quantity after the engine is revolved;

d) setting a start timing of the air/fuel mixture ratio feedback control on the basis of the accumulated value of the intake air quantity; and e) correcting a relationship between controls in an increase side and decrease side of the air/fuel mixture ratio with respect to the output voltage signal on the basis of the accumulated value of the intake air quantity after the start of the air/fuel mixture ratio feedback control.

* * * * *